US008939305B2

(12) United States Patent
Meyers et al.

(10) Patent No.: US 8,939,305 B2
(45) Date of Patent: Jan. 27, 2015

(54) LIQUID CONTAINER CLOSURE WITH INTEGRATED PUSH BUTTON LATCHING ASSEMBLY

(75) Inventors: David O. Meyers, Kaysville, UT (US); Steven M. Sorenson, Alpine, UT (US)

(73) Assignee: Runway Blue, LLC, Lehi, UT (US)

( * ) Notice: Subject to any disclaimer, the term of this patent is extended or adjusted under 35 U.S.C. 154(b) by 434 days.

(21) Appl. No.: 13/232,935

(22) Filed: Sep. 14, 2011

(65) Prior Publication Data

US 2013/0062351 A1 Mar. 14, 2013

(51) Int. Cl.
*B65D 47/08* (2006.01)

(52) U.S. Cl.
CPC ..... *B65D 47/0871* (2013.01)
USPC ..... 220/262; 220/254.4; 220/834

(58) Field of Classification Search
USPC ..... 215/245, 244, 322, 235, 246, 331, 237, 215/242, 342, 240; 220/811, 813, 812, 827, 220/832, 833, 834, 254.6, 254.3, 254.7, 220/254.5, 254.1, 831, 830, 824, 823, 220/259.1, 345.3, 264, 246, 262, 348; 222/556
See application file for complete search history.

(56) References Cited

U.S. PATENT DOCUMENTS

| | | | |
|---|---|---|---|
| 1,037,051 | A | 8/1912 | Ramsey |
| 1,094,469 | A | 4/1914 | Pick |
| 1,389,732 | A | 9/1921 | Baron |
| 1,479,053 | A | 1/1924 | Brooks |
| 1,573,620 | A | 2/1926 | Allston |
| 2,056,879 | A | 10/1936 | Winterhalter et al. |
| 2,272,867 | A | 2/1942 | Cobel |
| 2,514,573 | A | 7/1950 | Harrison |
| 2,573,378 | A | 10/1951 | Zurlinden |
| 2,574,876 | A | 11/1951 | Lebus |
| 2,575,299 | A | 11/1951 | Scheel |
| 2,638,253 | A | 5/1953 | Mueller |

(Continued)

FOREIGN PATENT DOCUMENTS

| | | |
|---|---|---|
| CN | 201139196 | 10/2008 |
| JP | 2006103793 A | 4/2004 |
| JP | 2008247404 | 10/2008 |

OTHER PUBLICATIONS

U.S. Appl. No. 12/762,292, filed Apr. 16, 2010, Meyers, et al.

(Continued)

*Primary Examiner* — Mickey Yu
*Assistant Examiner* — Allan Stevens
(74) *Attorney, Agent, or Firm* — Maschoff Brennan

(57) ABSTRACT

Closures having an integrated push button latching assembly including an end wall, a skirt wall depending from the end wall, an outlet opening associated with the end wall, a protrusion associated with the end wall and a push button latching assembly are disclosed. The push button latching assembly is pivotally coupled to the closure and is movable between a first position in which the outlet opening is covered by the assembly and a second position in which the outlet opening is exposed. The push button latching assembly includes a retaining mechanism, a closing member coupled to the retaining mechanism, a push button coupled to the retaining mechanism, and a tongue coupled to the retaining mechanism. The tongue is configured to engage the protrusion when the push button latching assembly occupies the first position and disengage the protrusion such that the push button latching assembly is movable to the second position.

20 Claims, 9 Drawing Sheets

(56) References Cited

U.S. PATENT DOCUMENTS

| | | | | |
|---|---|---|---|---|
| 2,748,997 | A | 6/1956 | Richmond, Sr. | |
| 2,752,971 | A | 7/1956 | Tupper | |
| 2,754,866 | A | 7/1956 | Coltman | |
| 3,022,925 | A | 2/1962 | Daniell | |
| 3,091,361 | A | 5/1963 | Gawron | |
| 3,143,205 | A | 8/1964 | Ruderian | |
| 3,144,016 | A | 8/1964 | Basci | |
| 3,168,226 | A | 2/1965 | Underwood | |
| 3,369,691 | A | 2/1968 | Wei | |
| 3,552,548 | A | 1/1971 | Wallestad et al. | |
| 3,770,160 | A | 11/1973 | Flider | |
| 3,820,692 | A | 6/1974 | Swett et al. | |
| D233,116 | S | 10/1974 | Swett et al. | |
| 4,022,352 | A | 5/1977 | Pehr | |
| 4,136,799 | A * | 1/1979 | Albert | 220/298 |
| 4,158,902 | A | 6/1979 | Chernack et al. | |
| D261,088 | S | 10/1981 | Akimov et al. | |
| 4,399,926 | A | 8/1983 | Eidels-Dubovoy | |
| 4,457,458 | A | 7/1984 | Heinol | |
| 4,474,303 | A | 10/1984 | Maccise | |
| 4,519,518 | A * | 5/1985 | Wiles et al. | 215/331 |
| 4,537,044 | A | 8/1985 | Putnam | |
| 4,735,333 | A | 4/1988 | Lay et al. | |
| 4,776,501 | A | 10/1988 | Ostrowsky | |
| 4,805,790 | A | 2/1989 | Leonetti et al. | |
| 4,932,225 | A | 6/1990 | Bighouse | |
| 5,065,877 | A | 11/1991 | Karppinen et al. | |
| 5,088,614 | A | 2/1992 | Dumestre | |
| D330,862 | S | 11/1992 | Shibley et al. | |
| 5,228,584 | A | 7/1993 | Williams, Jr. | |
| D342,898 | S | 1/1994 | Cane | |
| 5,289,930 | A | 3/1994 | Inouye | |
| D350,460 | S | 9/1994 | Picozza et al. | |
| 5,386,922 | A | 2/1995 | Jordan | |
| D356,499 | S | 3/1995 | Cautereels et al. | |
| 5,547,111 | A | 8/1996 | Geiger et al. | |
| 5,609,277 | A | 3/1997 | McDonald | |
| D382,968 | S | 8/1997 | Giles et al. | |
| D404,305 | S | 1/1999 | De Baschmakoff | |
| D405,654 | S | 2/1999 | Moran | |
| D421,547 | S | 3/2000 | Demers | |
| 6,161,713 | A * | 12/2000 | Krich | 215/384 |
| 6,283,333 | B1 | 9/2001 | Knickerbocker et al. | |
| 6,299,005 | B1 | 10/2001 | Higgins | |
| 6,379,032 | B1 | 4/2002 | Sorensen | |
| D458,081 | S | 6/2002 | Bodum | |
| D461,420 | S | 8/2002 | Kerman | |
| D497,431 | S | 10/2004 | Bentley | |
| 6,832,412 | B2 | 12/2004 | Kim | |
| 6,860,397 | B1 | 3/2005 | Walters, Jr. | |
| D504,273 | S | 4/2005 | Ancona | |
| D508,185 | S | 8/2005 | Gauss | |
| D510,235 | S | 10/2005 | Sorensen | |
| D518,336 | S | 4/2006 | Hirani | |
| 7,073,678 | B1 | 7/2006 | Dibdin et al. | |
| D526,827 | S | 8/2006 | Allen et al. | |
| D528,862 | S | 9/2006 | Li | |
| D529,339 | S | 10/2006 | Carreno et al. | |
| D532,650 | S | 11/2006 | de Groote | |
| D543,454 | S | 5/2007 | Leoncavallo et al. | |
| D546,131 | S | 7/2007 | Morales | |
| D547,607 | S | 7/2007 | Forsman | |
| D565,353 | S | 4/2008 | Roth et al. | |
| D574,190 | S | 8/2008 | Homma | |
| D580,227 | S | 11/2008 | Roth et al. | |
| D586,184 | S | 2/2009 | Miller et al. | |
| D587,069 | S | 2/2009 | Bodum | |
| D589,751 | S | 4/2009 | Liu et al. | |
| D592,913 | S | 5/2009 | Pinelli et al. | |
| 7,533,783 | B2 | 5/2009 | Choi et al. | |
| D593,811 | S | 6/2009 | Carreno | |
| D599,664 | S | 9/2009 | Fujinami et al. | |
| D604,103 | S | 11/2009 | Alviar et al. | |
| D609,970 | S | 2/2010 | Richau et al. | |
| D613,110 | S | 4/2010 | Lane et al. | |
| D622,089 | S | 8/2010 | Daniel et al. | |
| D622,554 | S | 8/2010 | Carreno | |
| 7,806,284 | B2 | 10/2010 | Mangano | |
| D626,837 | S | 11/2010 | Meyers et al. | |
| D626,838 | S | 11/2010 | Meyers et al. | |
| D628,483 | S | 12/2010 | McKinney et al. | |
| D629,657 | S | 12/2010 | Carreno | |
| 7,861,873 | B1 * | 1/2011 | Bragg et al. | 215/237 |
| 7,870,980 | B2 | 1/2011 | Wilson et al. | |
| D641,594 | S | 7/2011 | Huang | |
| D644,065 | S | 8/2011 | Llerena | |
| 8,020,257 | B2 | 9/2011 | Merten et al. | |
| D646,546 | S | 10/2011 | Robinson et al. | |
| D646,919 | S | 10/2011 | Nilsson | |
| D647,760 | S | 11/2011 | Pearson | |
| D652,256 | S | 1/2012 | Eyal | |
| D655,131 | S | 3/2012 | Nilsson | |
| D655,967 | S | 3/2012 | Bodum | |
| D656,357 | S | 3/2012 | Enghard | |
| D661,551 | S | 6/2012 | Gilbert | |
| D666,047 | S | 8/2012 | Lin | |
| D666,061 | S | 8/2012 | Ying | |
| D667,694 | S | 9/2012 | Meyers et al. | |
| 8,302,796 | B1 | 11/2012 | Johnson | |
| 8,342,349 | B2 | 1/2013 | Lu | |
| D677,121 | S | 3/2013 | Meyers et al. | |
| D686,885 | S | 7/2013 | Meyers et al. | |
| D686,886 | S | 7/2013 | Meyers et al. | |
| D686,887 | S | 7/2013 | Meyers et al. | |
| D686,888 | S | 7/2013 | Meyers et al. | |
| 2002/0074334 | A1 | 6/2002 | Karp | |
| 2003/0085228 | A1 | 5/2003 | Oakes | |
| 2004/0217139 | A1 | 11/2004 | Roth et al. | |
| 2004/0262306 | A1 | 12/2004 | Smith | |
| 2005/0045634 | A1 | 3/2005 | Ward et al. | |
| 2005/0045636 | A1 | 3/2005 | Lown et al. | |
| 2007/0012693 | A1 | 1/2007 | Kummer | |
| 2007/0175931 | A1 | 8/2007 | Leoncavallo et al. | |
| 2008/0099514 | A1 | 5/2008 | Carter et al. | |
| 2009/0178940 | A1 | 7/2009 | Said | |
| 2009/0188884 | A1 | 7/2009 | Nelson et al. | |
| 2009/0188933 | A1 | 7/2009 | Daams | |
| 2009/0301990 | A1 | 12/2009 | Cresswell et al. | |
| 2010/0200438 | A1 | 8/2010 | Davies | |
| 2010/0206835 | A1 | 8/2010 | Yu | |
| 2010/0224631 | A1 | 9/2010 | Roth et al. | |
| 2010/0282703 | A1 | 11/2010 | Yang | |
| 2011/0017760 | A1 | 1/2011 | Newman | |
| 2011/0253733 | A1 | 10/2011 | Meyers et al. | |

OTHER PUBLICATIONS

U.S. Appl. No. 13/232,891, filed Sep. 14, 2011, Meyers, et al.
U.S. Appl. No. 29/430,882, filed Aug. 30, 2012, Meyers, et al.
U.S. Appl. No. 29/431,544, filed Sep. 7, 2012, Meyers, et al.
U.S. Appl. No. 13/609,238, filed Sep. 10, 2012, Meyers, et al.
U.S. Appl. No. 13/610,445, filed Sep. 11, 2012, Meyers, et al.
U.S. Appl. No. 13/633,864, filed Oct. 2, 2012, Meyers, et al.
U.S. Appl. No. 29/457,097, filed Jun. 6, 2013, Sorensen, et al.
U.S. Appl. No. 29/457,096, filed Jun. 6, 2013, Sorensen, et al.
U.S. Appl. No. 61/832,085, filed Jun. 6, 2013, Sorensen, et al.
Koyono, http://www.koyono.com/KOR-ONA-Green-Zen-Water-Hydration-Vessel.sub- .--p/kor-one.htm, accessed Apr. 21, 2010.
Fit Sugar, www.fitsugar.com/2496788, accessed Apr. 21, 2010.
Goodlifter, http://www.goodlifer.com/2009/02/360-paper-water-bottle/, accessed Apr. 21, 2010.
Notice of Allowance from U.S. Appl. No. 29/430,882 dated Aug. 5, 2013 (copy attached).
Advisory Action from U.S. Appl. No. 12/762,292 dated May 24, 2013 (copy attached).
Office Action from U.S. Appl. No. 12/762,292 dated Jul. 1, 2013 (copy attached).
Office Action from U.S. Appl. No. 12/762,292 dated Oct. 2, 2012 (copy attached).
Office Action from U.S. Appl. No. 12/762,292 dated Jul. 17, 2012 (copy attached).
Office Action from U.S. Appl. No. 12/762,292 dated Feb. 10, 2012 (copy attached).

(56) References Cited

OTHER PUBLICATIONS

Notice of Allowance from U.S. Appl. No. 29/431,544 dated Aug. 14, 2013 (copy attached).
Office Action from U.S. Appl. No. 29/431,544 dated Mar. 25, 2013 (copy attached).
Office Action from U.S. Appl. No. 13/610,445 dated Mar. 29, 2013 (copy attached).
Office Action from U.S. Appl. No. 13/633,864 dated Mar. 29, 2013 (copy attached).
Office Action from U.S. Appl. No. 13/232,891 dated Jul. 19, 2013 (copy attached).
Office Action from U.S. Appl. No. 13/609,238 dated May 30, 2013 (copy attached).
International Search Report from PCT Application No. PCT/US2011/026508 dated Sep. 29, 2011 (copy attached).
Written Opinion from PCT Application No. PCT/US2011/026508 dated Sep. 29, 2011 (copy attached).
International Preliminary Report on Patentability from PCT Application No. PCT/US2011/026508 dated Oct. 16, 2012 (copy attached).
International Search Report from PCT Application No. PCT/US2012/054483 dated Nov. 16, 2012 (copy attached).
International Search Report and Written Opinion from PCT Application No. PCT/US2013/052132 dated Aug. 16, 2013 (copy attached).
International Search Report dated Nov. 20, 2012 for PCT/US2012/054497, which is the PCT application claiming priority to this application.

* cited by examiner

LIQUID CONTAINER CLOSURE WITH INTEGRATED PUSH BUTTON LATCHING ASSEMBLY

BACKGROUND OF THE INVENTION

1. Field of the Invention

The present invention relates to closures incorporating an integrated latching assembly, and more particularly to closures with an integrated push button latching assembly for liquid containers such as bottles.

2. Background and Related Art

Various types of bottles or containers have been developed in the past that include a closure to provide selective dispensing of liquid from the container. Typically, the closure is removably attached to the neck of the container so a user can remove the closure to add liquid, wet or dry ingredients, ice or other products into the container. The closure is then screwed or snapped onto the neck of the container to provide a generally watertight and leak-proof seal.

When a user desires to drink liquid from the container, the closure may be removed by unscrewing the closure to provide access into the reservoir of the container. The user drinks from an opening formed by the neck of the container and then replaces the closure onto the container to re-seal the container. In some instances, such as for outdoor activities (biking or hiking being examples), it is oftentimes desirable to have a closure provided with an outlet for faster access than that obtained by completely removing the closure, such as a push/pull spout or a flip top.

Push/pull spouts, flip tops and similar outlet mechanisms provide a certain amount of efficiency and ease of dispensing the contents of a container/bottle in lieu of removing the closure altogether. However, such mechanisms have limitations. For example, because a flip top cap snaps over a spout opening and is typically secured by friction, the flip top closure is not as secure as a screw-type closure. If a bottle/container is squeezed, dropped or develops internal pressure, for example, the internal pressure may be sufficient to overcome the friction holding the flip top cap against the spout and the contents of the bottle/container may be spilled. Push/pull spouts have similar limitations. In addition, because such mechanisms rely on friction between adjacent components, as the components wear during the course of use the closure may increasingly leak over time or extended use. Moreover, as such mechanisms wear, it is difficult to tactilely discern when the push/pull spout or flip top cap is in the fully closed position and the contents of the bottle/container may be inadvertently allowed to leak or pour out.

Thus, while techniques currently exist that are used to selective permit the contents of a bottle/container to be dispensed without requiring removal of the entire closure, challenges still exist. Accordingly, it would be an improvement in the art to augment or even replace current techniques with other techniques.

BRIEF SUMMARY OF THE INVENTION

A bottle/container closure with an integrated push button latching assembly is described.

Some implementations of the invention provide a lid with a spout opening that is closed by an integrated push button latching assembly. In some implementations, the push button latching assembly is pivotally attached to the lid at one or more pivot points defining a pivotal axis located opposite the spout on the top of the lid. In some implementations, the push button latching assembly includes one or more component parts, elements, or linkage mechanisms. In some implementations, one or more component parts comprising the push button latching assembly double to pivotally couple the push button latching assembly to the lid at the pivot points, which allows the push button latching assembly to pivot or rotate between a closed and sealed position to an open position that allows access to the contents of the container. In some implementations, the push button latching assembly includes a cap which extends over the spout of the lid and a push button mechanism extending generally over the opposite side of the lid. In some implementations, the cap forms a seal with the spout (such as along the inside of the spout or against the top outlet of the spout) and, when closed, is held in place by the interaction of a tongue coupled to the push button latching assembly and a protrusion associated with the top of the lid. In some implementations, the tongue is capable of being cyclically toggled between an engaged position and a disengaged position by operation of the push button mechanism.

In some implementations, the push button latching assembly is movable between the closed and sealed position and the open position which is capable of being accomplished or executed as a one handed operation by depressing the push button mechanism and disengaging a locking tongue to permit the push button latching assembly to open under spring biasing force. In some implementations, the push button latching assembly is returned from the open position to the closed and sealed position by reversing the operation previously described. In such implementations, closing the push button latching assembly is again capable of being accomplished or executed as a single handed operation by pressing the push button latching assembly closed and depressing the push button in a single fluid motion to thereby simultaneously cover the outlet opening with the cap and engage the locking tongue.

In some implementations, the push button latching assembly is configured for removal from the lid to enhance the ease and efficiency of cleaning the same. In some implementations, the push button latching assembly is pivotally attached to the lid by means of one or more spring biased pivot pins retained in a notch or slot formed in the lid. In some implementations, the configuration of the notch or slot permits a user to depress the spring biased pivot pins such that the push button latching assembly is removable from the lid. In some implementations, the push button latching assembly is returned to pivotal engagement with the lid by reversing the forgoing operation.

In some implementations, the lid is comprised of two separate components that are capable of being coupled together to form a sealed joint between them. In some implementations, the component parts of the lid permit the lid to have one component part having dis-continuous or non-planner formations while the other component part includes an internal continuous curvilinear surface so as to prevent debris or other foreign matter from becoming lodged in the formations of the first component part.

Thus, some implementations of the invention provide a closure having an integrated push button latching assembly for use with a liquid container. In some implementations, the closure includes a first closure component having a first end wall a first skirt wall depending from the first end wall, a first outlet opening associated with the first end wall, and a protrusion associated with the first end wall. In some implementations, the closure also includes push button latching assembly. In some implementations, the push button latching assembly is pivotally coupled to the first closure component and is movable between a first position in which the first outlet opening is covered by the push button latching assembly and a second position in which the first outlet opening is exposed. In some implementations, the push button latching assembly includes a retaining mechanism, a closing member coupled to the retaining mechanism, a push button coupled to the retaining mechanism, and a tongue coupled to the retaining mechanism. In some implementations, the tongue is configured to matingly engage the protrusion when the push button latching assembly occupies the first position and disengage the protrusion such that the push button latching assembly is movable to the second position, the push button is configured to cyclically toggle the tongue between engagement and disengagement with the protrusion and the closing member is configured to close the first outlet opening when the push button latching assembly occupies the first position.

Further implementation of the invention provides a closure comprised of a second closure component having a second end wall, a second skirt wall depending from the second end wall and a second outlet opening associated with the second end wall. In various implementations, the second closure component includes an internal surface comprising a continuous curvilinear surface.

Some additional implementations provide a closure having an integrated push button latching assembly for use with a liquid container. In some implementations, the closure includes an end wall, a skirt wall depending from the end wall, an outlet opening associated with the end wall and a protrusion associated with the end wall. In some implementations, the closure also includes a push button latching assembly. In some implementations, the push button latching assembly is pivotally coupled to the closure and is movable between a first position in which the outlet opening is covered by the push button latching assembly and a second position in which the outlet opening is exposed. In some implementations, the closure is configured to be removably secured to a neck of a liquid container, such as a bottle, and to provide an essentially liquid-tight, liquid sealing and/or leak-proof seal with the container neck. In some implementations, the outlet opening permits access to the liquid contents, and the push button latching assembly seals the outlet opening to keep the liquid contents in the container and prevent spillage.

BRIEF DESCRIPTION OF THE SEVERAL VIEWS OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

Figure 1:
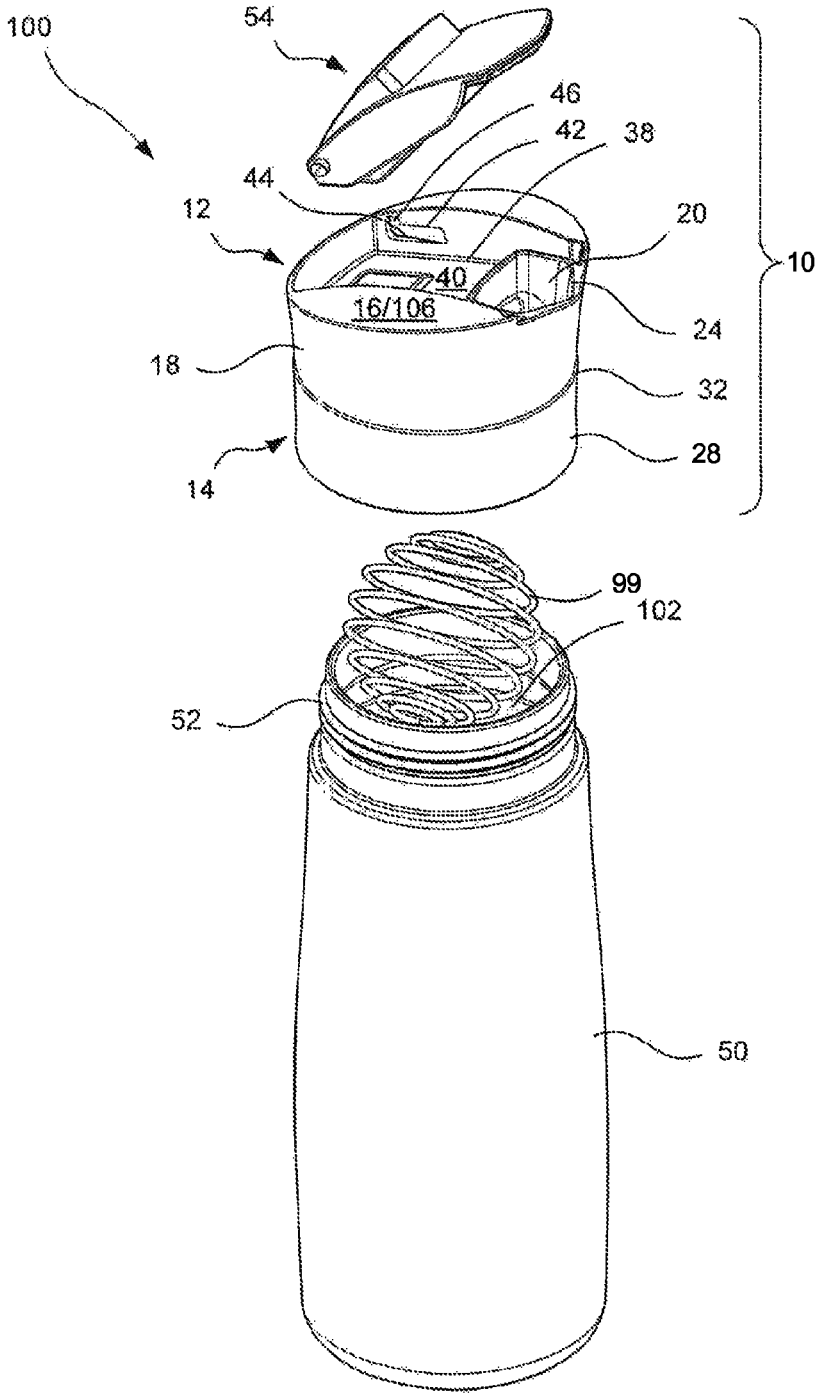
FIG. 1 illustrates a partially-exploded perspective view of an embodiment of a bottle and closure system wherein the closure has an integrated push button latching assembly.

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The description may use perspective-based descriptions such as up/down, back/front, left/right and top/bottom. Such descriptions are merely used to facilitate the discussion and are not intended to restrict the application or embodiments of the present invention.

For the purposes of the present invention, the phrase "A/B" means A or B. For the purposes of the present invention, the phrase "A and/or B" means "(A), (B), or (A and B)." For the purposes of the present invention, the phrase "at least one of A, B, and C" means "(A), (B), (C), (A and B), (A and C), (B and C), or (A, B and C)." For the purposes of the present invention, the phrase "(A)B" means "(B) or (AB)", that is, A is an optional element.

Various operations may be described as multiple discrete operations in turn, in a manner that may be helpful in understanding embodiments of the present invention; however, the order of description should not be construed to imply that these operations are order dependent.

The description may use the phrases "in an embodiment," or "in various embodiments," which may each refer to one or more of the same or different embodiments. Furthermore, the terms "comprising," "including," "having," and the like, as used with respect to embodiments of the present invention, are synonymous with the definition afforded the term "comprising."

The terms "coupled" and "connected," along with their derivatives, may be used. It should be understood that these terms are not intended as synonyms for each other. Rather, in particular embodiments, "connected" may be used to indicate that two or more elements are in direct physical contact with each other. "Coupled" may mean that two or more elements are in direct physical or electrical contact. However, "coupled" may also mean that two or more elements are not in direct contact with each other, but yet still cooperate or interact with each other.

As mentioned above, the present invention relates to closures incorporating an integrated latching assembly, and more particularly to closures with an integrated push button latching assembly for liquid containers such as bottles. Thus, a bottle/container closure with an integrated push button latching assembly is described.

Some embodiments of the invention provide a lid with a spout opening that is closed by an integrated push button latching assembly. In some embodiments, the push button latching assembly is pivotally attached to the lid at one or more pivot points defining a pivotal axis located opposite the spout on the top of the lid. In some embodiments, the push button latching assembly includes one or more component parts, elements, or linkage mechanisms. In some embodiments, one or more component parts comprising the push button latching assembly double to pivotally couple the push button latching assembly to the lid at the pivot points, which allows the push button latching assembly to pivot or rotate between a closed and sealed position to an open position that allows access to the contents of the container. In some embodiments, the push button latching assembly includes a cap which extends over the spout of the lid and a push button mechanism extending generally over the opposite side of the lid. In some embodiments, the cap forms a seal with the spout (such as along the inside of the spout or against the top outlet of the spout) and, when closed, is held in place by the interaction of a tongue coupled to the push button latching assembly and a protrusion associated with the top of the lid. In some embodiments, the tongue is capable of being cyclically toggled between an engaged position and a disengaged position by operation of the push button mechanism.

In some embodiments, the push button latching assembly is movable between the closed and sealed position and the open position which is capable of being accomplished or executed as a one handed operation by depressing the push button mechanism and disengaging a locking tongue to permit the push button latching assembly to open under spring biasing force. In some embodiments, the push button latching assembly is returned from the open position to the closed and sealed position by reversing the operation previously described. In such embodiments, closing the push button latching assembly is again capable of being accomplished or executed as a single handed operation by pressing the push button latching assembly closed and depressing the push button in a single fluid motion to thereby simultaneously cover the outlet opening with the cap and engage the locking tongue.

In some embodiments, the push button latching assembly is configured for removal from the lid to enhance the ease and efficiency of cleaning the same. In some embodiments, the push button latching assembly is pivotally attached to the lid by means of one or more spring biased pivot pins retained in a notch or slot formed in the lid. In some embodiments, the configuration of the notch or slot permits a user to depress the spring biased pivot pins such that the push button latching assembly is removable from the lid. In some embodiments, the push button latching assembly is returned to pivotal engagement with the lid by reversing the forgoing operation.

In some embodiments, the lid is comprised of two separate components that are capable of being coupled together to form a sealed joint between them. In some embodiments, the component parts of the lid permit the lid to have one component part having dis-continuous or non-planner formations while the other component part includes an internal continuous curvilinear surface so as to prevent debris or other foreign matter from becoming lodged in the formations of the first component part.

Thus, some embodiments of the invention provide a closure having an integrated push button latching assembly for use with a liquid container. In some embodiments, the closure includes a first closure component having a first end wall a first skirt wall depending from the first end wall, a first outlet opening associated with the first end wall, and a protrusion associated with the first end wall. In some embodiments, the closure also includes push button latching assembly. In some embodiments, the push button latching assembly is pivotally coupled to the first closure component and is movable between a first position in which the first outlet opening is covered by the push button latching assembly and a second position in which the first outlet opening is exposed. In some embodiments, the push button latching assembly includes a retaining mechanism, a closing member coupled to the retaining mechanism, a push button coupled to the retaining mechanism, and a tongue coupled to the retaining mechanism. In some embodiments, the tongue is configured to matingly engage the protrusion when the push button latching assembly occupies the first position and disengage the protrusion such that the push button latching assembly is movable to the second position, the push button is configured to cyclically toggle the tongue between engagement and disengagement with the protrusion and the closing member is configured to close the first outlet opening when the push button latching assembly occupies the first position.

Further embodiments of the invention provide a closure comprised of a second closure component having a second end wall, a second skirt wall depending from the second end wall and a second outlet opening associated with the second end wall. In various embodiments, the second closure component includes an internal surface comprising a continuous curvilinear surface.

Some additional embodiments provide a closure having an integrated push button latching assembly for use with a liquid container. In some embodiments, the closure includes an end wall, a skirt wall depending from the end wall, an outlet opening associated with the end wall and a protrusion associated with the end wall. In some embodiments, the closure also includes a push button latching assembly. In some embodiments, the push button latching assembly is pivotally coupled to the closure and is movable between a first position in which the outlet opening is covered by the push button latching assembly and a second position in which the outlet opening is exposed. In some embodiments, the closure is configured to be removably secured to a neck of a liquid container, such as a bottle, and to provide an essentially fluid-tight, liquid sealing and/or leak-proof seal with the container neck. In some embodiments, the outlet opening permits access to the liquid contents, and the push button latching assembly seals the outlet opening to keep the liquid contents in the container and prevent spillage.

With reference now to the figures, FIG. 1 illustrates an exploded perspective view of one embodiment of a system 100 comprised of a bottle or liquid container 50 and a closure 10. In some embodiments, the bottle/container and closure system 100 only include bottle 50 and closure 10. In other embodiments, however, system 100 further comprises a selectively removable blending or whisk ball 99, a removable internal an egg separator (not shown), a strainer or sieve (not shown) or other devices to facilitate adding and/or mixing combinations of ingredients within system 100 or straining certain ingredients as they are added to system 100 or when the contents of system 100 are being dispensed. In embodiments contemplating the inclusion of a removable egg separator, bottle 50 and the egg separator comprise corresponding circumferential lips, rings or ledges configured to selectively retain the egg separator within a reservoir 102 defined by bottle 50 when closure 10 is secured thereto.

In various embodiments, bottle 50 also comprises additional features, such as an integrated measuring system (not shown). In various embodiments, bottle 50 may be comprised of any suitable or desirable bottle size or shape. Further, in embodiments comprising an integrated measuring system, any suitable or desirable metric may be used to denote the measured contents of bottle 50. In some additional embodiments, bottle 50 includes a gripping surface (not shown) configured to facilitate manual handling or a user's grip of bottle 50 such that the bottle can be easily handled and gripped sufficiently tight to permit vigorous shaking of system 100. In some embodiments, the gripping surface includes one or more bumps, ridges, lines, protuberances, crests, folds, knobs, bulges, lumps or other protrusions configured to facilitate and enhance a user's grip with the bottle. In some embodiments, formations are selected for their ability to minimize moister or other substances on the gripping surface, such as oil, to thereby minimize the risk of having the bottle slip out of the user's grasp.

Figure 2:
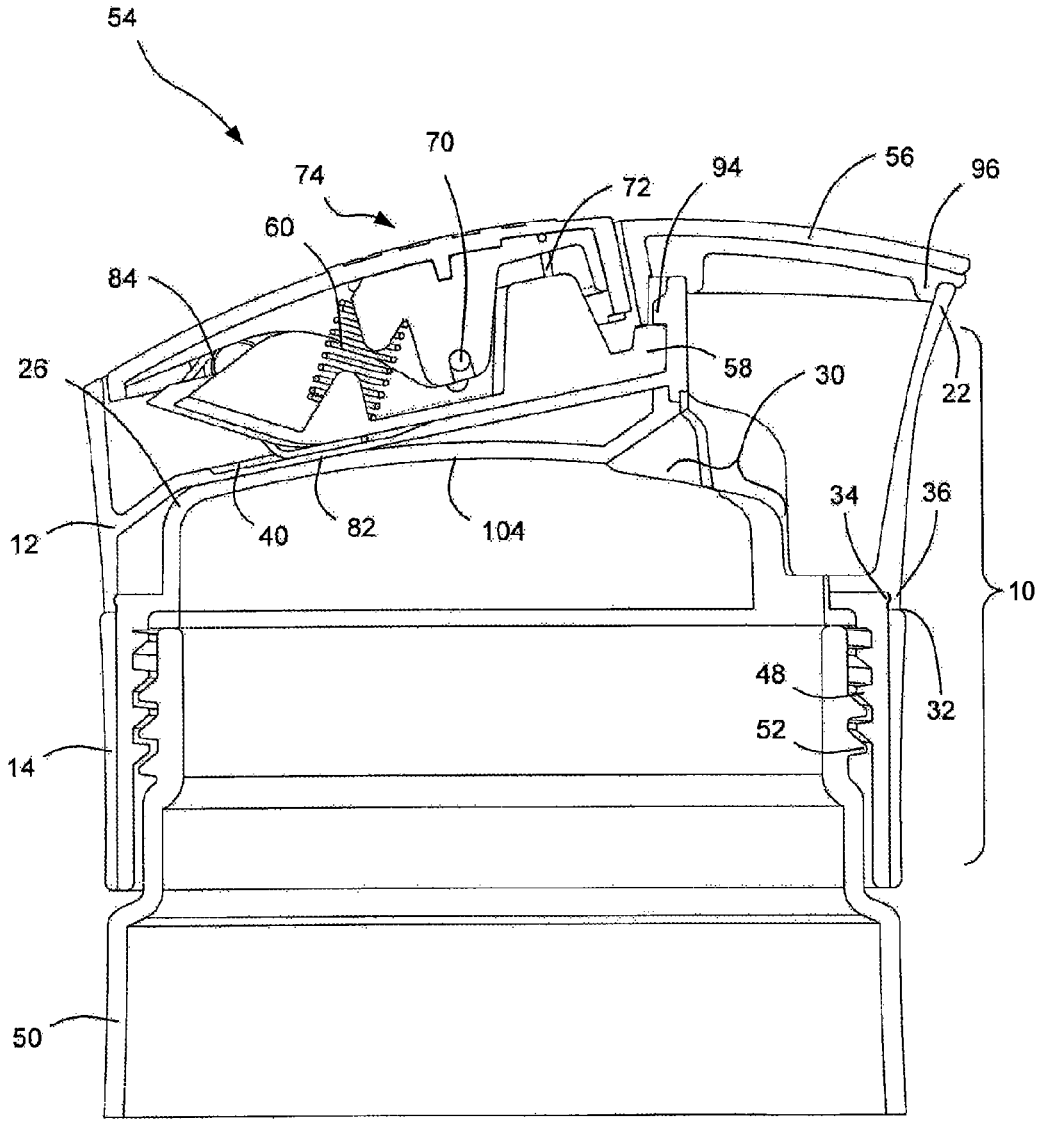
FIG. 2 illustrates a cross-sectional side view of an embodiment of a bottle closure with an integrated push button latching assembly in a closed position.

With continued reference to FIG. 1 as well as reference to the sectional view of FIG. 2, in some embodiments closure 10 includes a first closure component 12 having a first end wall 16 and a first skirt wall 18 depending from first end wall 16. In some embodiments, closure 10 further includes a second closure component 14 having a second end wall 26 (shown in cross-section in FIG. 2) and a second skirt wall 28 depending from second end wall 26. In such embodiments, first closure component 12 and second closure component 14 are interlockable along a common axis such that first and second skirt walls 18, 28 are axially aligned. In various embodiments, first closure component 12 includes a first outlet opening or spout opening 20 and in other embodiments second closure component 14 includes a second outlet opening 30 (shown in cross-section in FIG. 2). In such embodiments, when the first and second closure components 12, 14 are interlocked, first and second outlet openings 20, 30 are aligned to permit the contents of bottle 50 to be poured or dispensed through the outlet openings 20, 30 when a latching assembly 54 is moved to the open position.

In embodiments contemplating closure 10 comprising two closure components 12, 14, the components 12, 14 are capable of being coupled together to form a sealed joint between them. In some embodiments, over molding seals or other sealing means, such as a gasket, are used to form a liquid seal between first component 12 and second component 14 when the components are joined or interlocked. In other embodiments first component 12 and second component 14 are formed or manufactured as a single component. In various embodiments any means for securing components 12, 14 together, such as threads, a ridge for a press or snap fit, or any similar structure known in the art is contemplated. By way of example and not limitation, in some embodiments components 12, 14 are interlockable at joint 32. In such embodiments, joint 32 is comprised of a grove or circumferential indent 36 (FIG. 2) disposed on either first component 12 or second component 14 and a corresponding circumferential tongue, tab or protrusion 34 (FIG. 2) disposed on the opposite of either first component 12 or second component 14 and vice versa. In other embodiments, first component 12 and second component 14 are joined by threaded means disposed in a similar fashion to tongue 34 and grove 36. In each of the forgoing embodiments, the liquid seal between first component 12 and second component 14 allows the components to be selectively disassembled as desired while simultaneously preventing water or other foreign substances from becoming entrapped within closure 10 and either becoming stale, rotten or otherwise jeopardizing the integrity of closure 10 or the hygienic or otherwise sanitary environment defined by bottle 50.

In some embodiments, the component parts 12, 14 of closure 10 permit first component 12 to be formed having discontinuous or non-planner formations, such as nooks, crannies, or other cavities formed on the underside thereof. In such embodiments, second component part 14 is formed having a continuous internal curvilinear surface 104 (FIG. 2). In such embodiments, the continuous internal curvilinear surface 104 is free of cavities and the like save for outlet opening 30.

In such embodiments, second end wall 26 and second skirt wall 28 serve to close the liquid container or bottle 50, and second skirt wall 28 may include any means for securing joined or combined closure 10 to liquid container/bottle 50, such as threads, a ridge for a press or snap fit, or any similar structure, as known in the art. For example, in some embodiments, as depicted in FIG. 1, bottle 50 includes external threads 52 disposed on the neck of bottle 50. In such embodiments, second skirt wall 28 includes corresponding internal threads (seen in cross-section at 48 in FIG. 2) for securing closure 10 to liquid container 50. In various embodiments, sealing means common to those of skill in the art are used to facilitate a liquid sealing engagement between closure 10 and bottle 50, such as a gasket.

In some embodiments, external threads 52 include a terminal abutment or shoulder (not shown). In such embodiments, internal threads 48 include a corresponding terminal abutment (not shown). In this way, closure 10 is secured to liquid container 50 by matingly engaging external threads 52 with internal threads 48 and rotating closure 10 in an appropriate direction (some embodiments contemplate left-handed threading while other embodiments contemplate right-handed threading) until the corresponding terminal abutments associated with internal threads 48 and external threads 52 meet thereby arresting the user's ability to threadingly rotate closure 10. In this way, closure 10 can be repeatedly and consistently secured to bottle 50 so as to always maintain a liquid sealing engagement therewith without over tightening closure 10 and either deforming or damaging the component parts of system 100. In addition, in embodiments where it is desirable to maintain a specific mating orientation between closure 10 and bottle 50, such can be accomplished by positioning the shoulder or terminal abutment at an appropriate location during the manufacturing process. In this way, the convenience and efficacy of various features included with system 100 are enhanced. Moreover, the user is able to determine whether closure 10 is fully secured to bottle 50 simply by a visual inspection.

In some embodiments, the combination of first component 12 and second component 14 prevents debris or other foreign matter from becoming lodged in any cavities formed on the underside of first component 12. In such embodiments, features such as whisk ball 99 can be effectively used with system 100 such that all ingredients supplied to the system can be thoroughly mixed without some ingredients being lodged within a cavity of first component 12 where whisk ball 99 is too large to traverse.

In some embodiments, closure 10 is formed from only one component having a single end wall and a single skirt wall depending therefrom which is configured as described above for secure engagement with the neck of bottle 50. For convenience, and not by way of limitation, the remaining discussion will refer to a closure 10 as a single unit having one end wall and one skirt wall. In, various embodiments, closure 10 includes an outlet opening 20 (e.g. a spout) associated with the end wall 106. In such embodiments, the outlet opening 20 provides access to the contents of the liquid container 50 without requiring removal of the entire closure 10 from the liquid container. In the embodiment illustrated in the Figures, the outlet opening 20 terminates a spout 22 (FIGS. 1 and 2) extending from the end wall 106.

With continued reference to FIG. 1, some embodiments of closure 10 include a depression 40, slot 42, notch or slot 46, which in some embodiments is substantially perpendicular to slot 42, and slot ramp 44. The foregoing features of closure 10 facilitate the function and pivotal engagement of closure 10 and push button latching assembly 54 as well as the removal and replacement of push button latching assembly 54.

In various embodiments, push button latching assembly 54 is comprised of various additional elements. As clearly seen in FIG. 2, some embodiments of push button latching assembly 54 are comprised of a closing member or spout cap 56. In some embodiments, a sealing material 96, such as a soft durometer rubber or other similar materials adapted to facilitate a liquid sealing engagement between two parts is disposed on the underside of closing member 56. In other embodiments, such a material is disposed around or adjacent the opening 20. In still further embodiments, material 96 is disposed on both the underside of closing member 56 and the contact surface surrounding opening 20 or the surface of opening 20 which closing member 56 contacts when the push button latching assembly is moved to a closed position. In yet additional embodiments, one or more ridges 24 (FIG. 1) may be formed in either the underside of closing member 56, the opening 20, or the sealing material 96 associated with either of the forgoing to further enhance a liquid sealing engagement between opening 20 and closing member 56.

Figure 7:
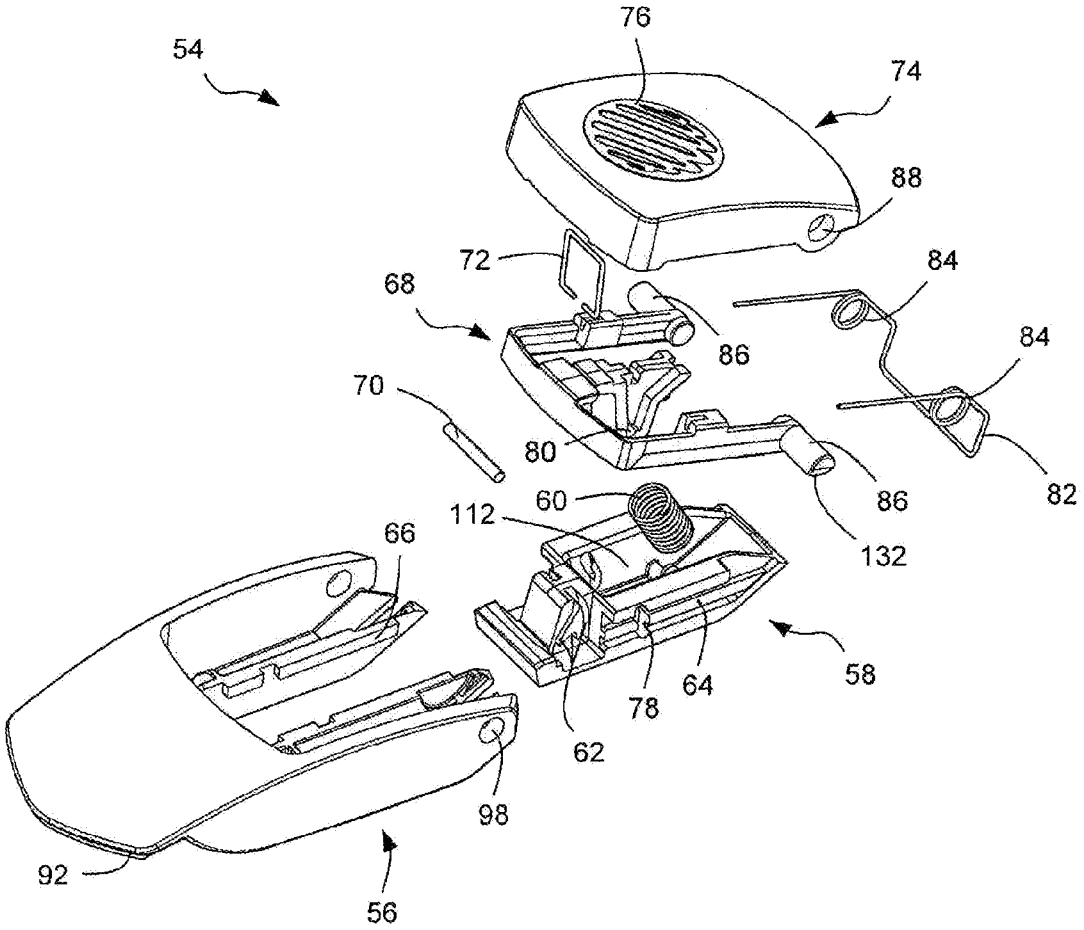
FIG. 7 illustrates an exploded perspective view of an embodiment of a push button latching assembly.

Turning now briefly to FIG. 7, various embodiments of push button latching assembly 54 will be discussed in further detail. As shown, FIG. 7 illustrates an enlarged exploded perspective view of an embodiment of a push button latching assembly 54. In various embodiments, push button latching assembly 54 is comprised of various component parts or elements. As seen in FIG. 7, some embodiments of push button latching assembly 54 are comprised of a retaining mechanism or retainer clip 68, closing member or spout cap 56, which in some embodiments is coupled to retaining clip 68, a push button 74, which is some embodiments is also coupled to retaining clip 68, and a tongue 58, which, according to some embodiments, is also coupled to retaining clip 68. In some embodiments, a gripping means or surface 76 is formed or disposed on push button 74. In various embodiments, push button latching assembly 54 also includes additional component parts or elements such as a spring 60, a pin 70, a torsion spring 82 having spring coils 84, and/or a reversing mechanism or reversing spring 72. In various embodiments, the several component parts of push button latching mechanism 54 are further comprised of additional functional features or components, such as tracks 62, which in some embodiments are molded into tongue 58, angled slots 78, hole 80, pivot retaining pins 86, tongues 64, corresponding grooves 66, sealing surface 92, which in some embodiments includes ridges 24 (FIG. 1) to facilitate a liquid sealing engagement between closing member 56 and outlet opening 20, and/or holes 88 and 98.

In various embodiments, push button latching assembly 54 is assembled from one or more of the component parts identified and listed above. By way of example and not limitation, in some embodiments the component parts of push button latching assembly 54 are assembled as follows. In some embodiments, the reversing mechanism 72 is placed in the retaining clip 68. In some embodiments, retaining clip 68 is then pressed into the bottom side of push button 74 and the combination is held together as pivot retaining pins 86 are inserted through holes 88.

In some embodiments, as shown in FIG. 7, retaining clip 68 is formed of any suitable product capable of elastic deformation such that retainer clip 68/pivot retaining pins 86 can be moved to accommodate assembly of the push button latching assembly 54 while retaining the memory necessary to allow retaining clip 68 to resume is pre-deformation shape and drive pivot retaining pins 86 through holes 88. According to some embodiments, the assembly of retaining clip 68 and push button 74 as described above results in the capture of reversing mechanism 72 such that it assumes an appropriate functional orientation.

In some embodiments, torsion spring 82 is next inserted or otherwise coupled to retainer clip 68 with coils 84 abutting internal protrusions which form the back end of pivot retaining pins 86. In this way, an additional biasing force is applied to pivot retaining pins 86 via torsion spring 82 so as to retain pivot retaining pins 86 in inserted engagement with holes 88. In some embodiments, the retaining clip 68, reversing mechanism 72, torsion spring 82 and push button 74 combination is slipped into a cavity 112 defined by tongue 58 and pin 70 is driven or pressed through angled slots 78 and hole 80 thereby capturing the above-identified combination of components in relation to tongue 58. In various embodiments, spring 60 is simultaneously or later placed within cavity 112 between tongue 58 and push button 74. In such embodiments, spring 60 provides a biasing force which biases push button 74 against cavity 112 so as to facilitate the cyclical toggling of push button latching assembly 54 by permitting push button 74 to be repeatedly or cyclically pushed while always returning to a non-depressed or pre-pushed state.

According to some embodiments, the combination of elements discussed above is then coupled to closing member 56 by inserting pivot retaining pins 86 through holes 98 as described previously with reference to holes 88. In some embodiments, corresponding groove and tongue features associated with tongue 58 and closing member 56, such as 64, 66 are also matably engaged as push button latching assembly 54 is fully assembled.

Figure 8:
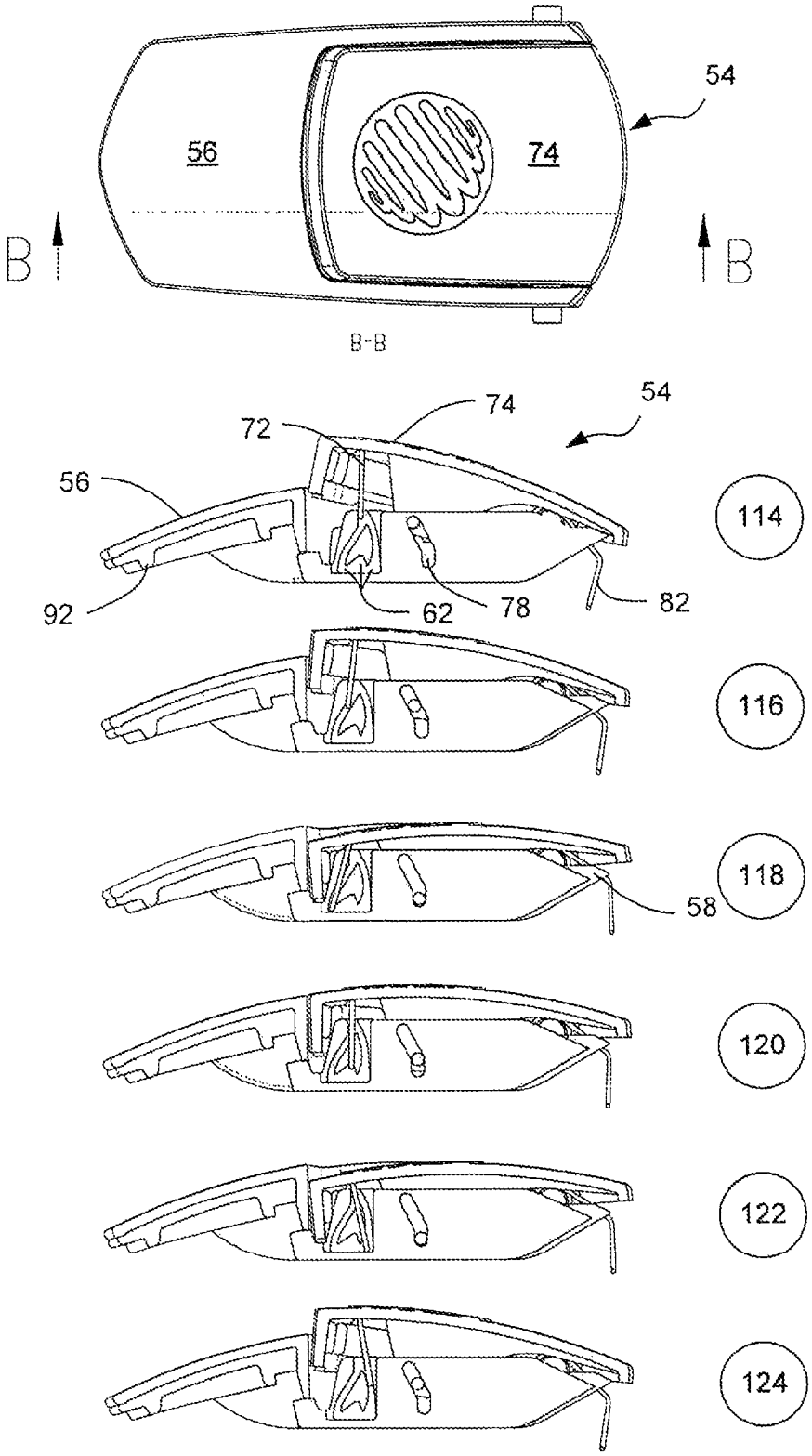
FIG. 8 illustrates a series of left-side sectional views of an embodiment of a push button latching assembly depicting the operation of a reversing mechanism.
Figure 9:
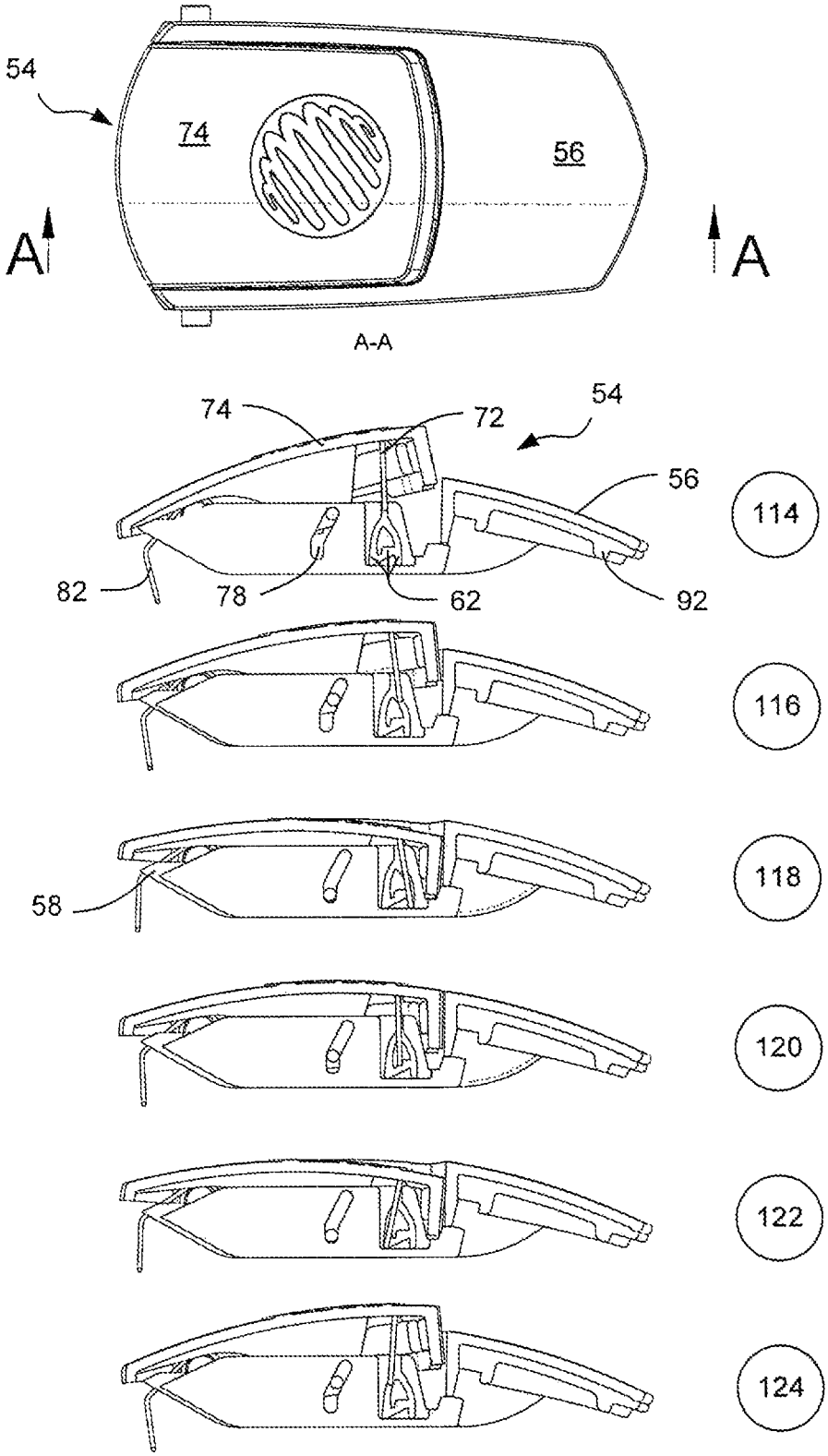
FIG. 9 illustrates a series of right-side sectional views thereof depicting the operation of the reversing mechanism.

Turning now briefly to FIGS. 8 and 9, which illustrate a series of left- and right-side views of an embodiment of push button latching assembly 54 taken along lines B-B and A-A, respectively, the operation of the reversing mechanism 72 and tracks 62 will be described in further detail. In embodiments contemplating a reversing mechanism 72, the reversing mechanism, in combination with spring 60, facilitate transitioning push button latching assembly 54 between a closed and sealed engagement with closure 10 and an open position.

As depicted in FIGS. 8 and 9 at 114, when the push button latching assembly is unlatched or otherwise occupying the open position, reversing mechanism 72 is oriented relative to the top of tracks 62 according to various embodiments. As seen in FIG. 7, reversing mechanism 72 includes a gap located adjacent track 62 openings such that reversing mechanism 72 is allowed to straddle the material in which tracks 62 are formed having one side thereof running through the series of tracks depicted in FIG. 8 while the other side thereof simultaneous traverses a unique series of tracks depicted in FIG. 9. The unique sets of tracks corresponding with FIGS. 8 and 9, respectively, permit reversing mechanism 72 to be pushed, pulled, dragged or otherwise forced and/or snapped into a series of positions in the corresponding tracks. Such positions generally correspond to the closed (or engaged) or open (or disengaged) positions of push button 74 and the associated assembly 54. In this way, according to some embodiments, each time push button 74 is depressed or compressed, reversing mechanism 72 is snapped into a position requiring push button 74 to be pushed and released a total of two times to run the reversing mechanism 72 through a complete cycle or to complete the cycle designated and defined by tracks 62. Pushing and releasing the push button 74 once, therefore, corresponds with a disengaged or open position of assembly 54 while pushing and releasing the push button 74 again corresponds with an engaged or closed and sealed position of assembly 54. As mentioned above, spring 60 (FIG. 7) facilitates the repeated and cyclical compression or depression of push button 74 in order to facilitate cyclically engaging and disengaging push button latching assembly 54 relative to closure 10.

With continued reference to FIGS. 8 and 9, as push button 74 is pushed from the position represented at 114, reversing mechanism 72 traverses one of tracks 62, wherein the tracks 62 on the left side are unique from the tracks 62 on the right side according to the various embodiments disclosed herein. In such embodiments, the two sides of reversing mechanism 72 travel the path defined by tracks 62 as shown at 116, 118, 120, 122 and 124. Notably, according to such embodiments, the position associated with 124 returns reversing mechanism 72 to the identical position in which it started the cycle as shown at 114. As mentioned above, the full cycle depicted in FIGS. 8 and 9 corresponds with two depressions and releases of push button 74.

According to some embodiments, tracks 62 are angled forward as shown in FIGS. 8 and 9. In such embodiments, tracks 62 permit tongue 58 (FIG. 7) to slide toward closing member 56 and withdraw to its original position as reversing member 72 completes a cycle corresponding with two pushes or depressions of push button 74. In this way, the tongue is capable of slidably engaging and disengaging corresponding features of closure 10 (discussed in greater detail below) so as to effectively lock push button assembly 54 in a closed position or selectively unlock push button assembly 54 and permit the same to open under spring biasing force provided by torsion spring 82. Put differently, when push button 74 is in the closed position, tongue 58 is locked in an extended position holding closing member 56 closed against spout 20 of closure 10. As button 74 is released into the open position, tongue 58 is retracted allowing torsion spring 82 to push closing member 56 into the open position and maintain the assembly in the open position.

In various embodiments, as shown in FIGS. 8 and 9, pin 70 and angled slots 78 also contribute to slide tongue 58 into a locking engaged position and subsequently retract tongue 58 into an unlocked or disengaged position.

With reference now back to FIGS. 2 through 6, a method according to some embodiments for opening push button latching assembly 54 and/or removing push button latching assembly 54 from closure 10 for cleaning will now be discussed. FIGS. 2 through 7 depict a cross-sectional side view of an embodiment of closure 10 having an integrated push button latching assembly 54 as the same is transitioned through various positions including closed, open, and removal of push button latching assembly 54.

Figure 3:
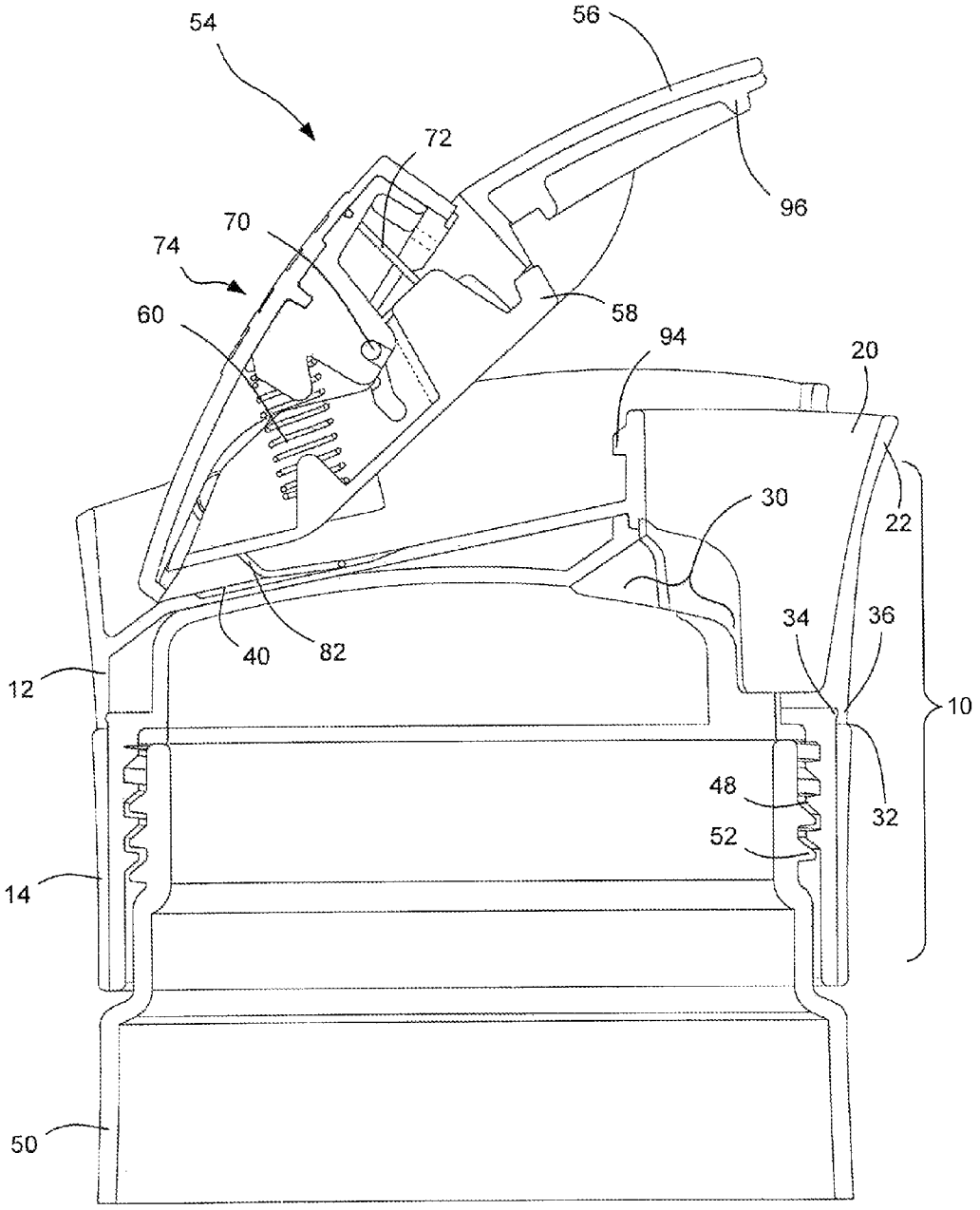
FIG. 3 illustrates a cross-sectional side view thereof with an integrated push button latching assembly in an open position.

As depicted in FIG. 2, wherein the push button latching assembly is depicted in a closed and locked position, some embodiments of closure 10 include or comprise a protrusion, protuberance or lip 94 associated with end wall 106 (FIG. 1). When push button latching assembly 54 is in the closed and locked position, as discussed briefly above, tongue 58 is matingly engaged with protrusion 94. In some embodiments, protrusion 94 includes a chamfer on the underside to additionally bias closing member 56 in a closed and sealed position against outlet opening 20 when the push button latching assembly 54 is in the closed position. According to some embodiments, push button 74 is capable of being pushed (by an external forces, such as force applied by a user's index finger) as discussed and described previously such that tongue 58 is disengaged from protrusion 94. In such embodiments, torsion spring 82, for which space is provided at depression 40, provides a biasing force overcoming the gravitational or fictional forces on push button latching assembly 54 such that the assembly 54 is moved to an open position as shown in FIG. 3.

According to various embodiments, the foregoing steps can be executed in reverse to return push button latching assembly 54 to a closed, locked and sealed position. Specifically, according to such embodiments, starting from the position depicted in FIG. 3, an external force, such as force applied by a user's index finger, can be applied such that push button latching assembly 54 is moved or rotated downward until closing member 56 contacts outlet opening 20 at which point push button 74 can be depressed thereby toggling tongue 58 into locking engagement with protrusion 94 as shown and described with reference to FIG. 2 above. According to various embodiments, push button 74, in combination with spring 60 as well as other component parts of push button assembly 54, is configured to be repeated and cyclically compressed and released so as to cyclically toggle tongue 58 between engagement corresponding with a closed position (FIG. 2) and disengagement corresponding with an open position (FIG. 3).

In various embodiments, the system 100 is configured for one handed or singled handed operation and/or use. Specifically, in such embodiments, a user is able to use one hand to pick up bottle 50, shake bottle 50 (to mix the contents thereof, which in some embodiments is augmented or assisted by whisk ball 99), open bottle 50 by applying a compressing force to push button 74 with their index finger and allowing torsion spring 82 to bias closing member 56 and the associated assembly 54 into an open position, dispensing the contents of bottle 50 via spout 22, closing the push button latching assembly by applying a downward force to the assembly with their index finger and re-compressing push button 74 a second time to lockingly engage tongue 58 with protrusion 94 and returning the bottle to the surrounding environment. In this way, system 100 may be conveniently used in a variety of settings, including outdoor settings, where the user is mobile and the like. In some embodiments, closing the push button latching assembly is executed by applying a downward force in a single fluid motion to thereby simultaneously cover outlet opening 20 with the closing member 56 and engage locking tongue 58 with protrusion 94.

In various embodiments, as mentioned briefly above, push button latching assembly 54 includes pivot retaining pins 86. With brief reference back to FIG. 1, pins 86 are configured to pivotally engage push button latching assembly 54 at the slots/notches 42/46 formed in a cavity 38 defined within end wall 106. In this way, according to such embodiments, push button latching assembly 54 is pivotally engaged with closure 10 such that it can be pivoted or rotated between the open and closed positions discussed above. In some embodiments, the slots/notches 42/46 can be thought of as pivot mounts or hinge type configurations.

In some embodiments, as mentioned above, pivot retaining pins 86 are capable of being temporarily elastically displaced such that they may then be allowed to return to engagement with both holes 88 and 98 as well as slots/notches 42/46. According to some embodiments, as depicted in FIG. 7, pivot retaining pins 86 are chamfered at 132. In this way, pivot retaining pins 86 are capable of being depressed by pressing them against another surface and applying a downward or perpendicular force to push button latching assembly 54.

Figure 4:
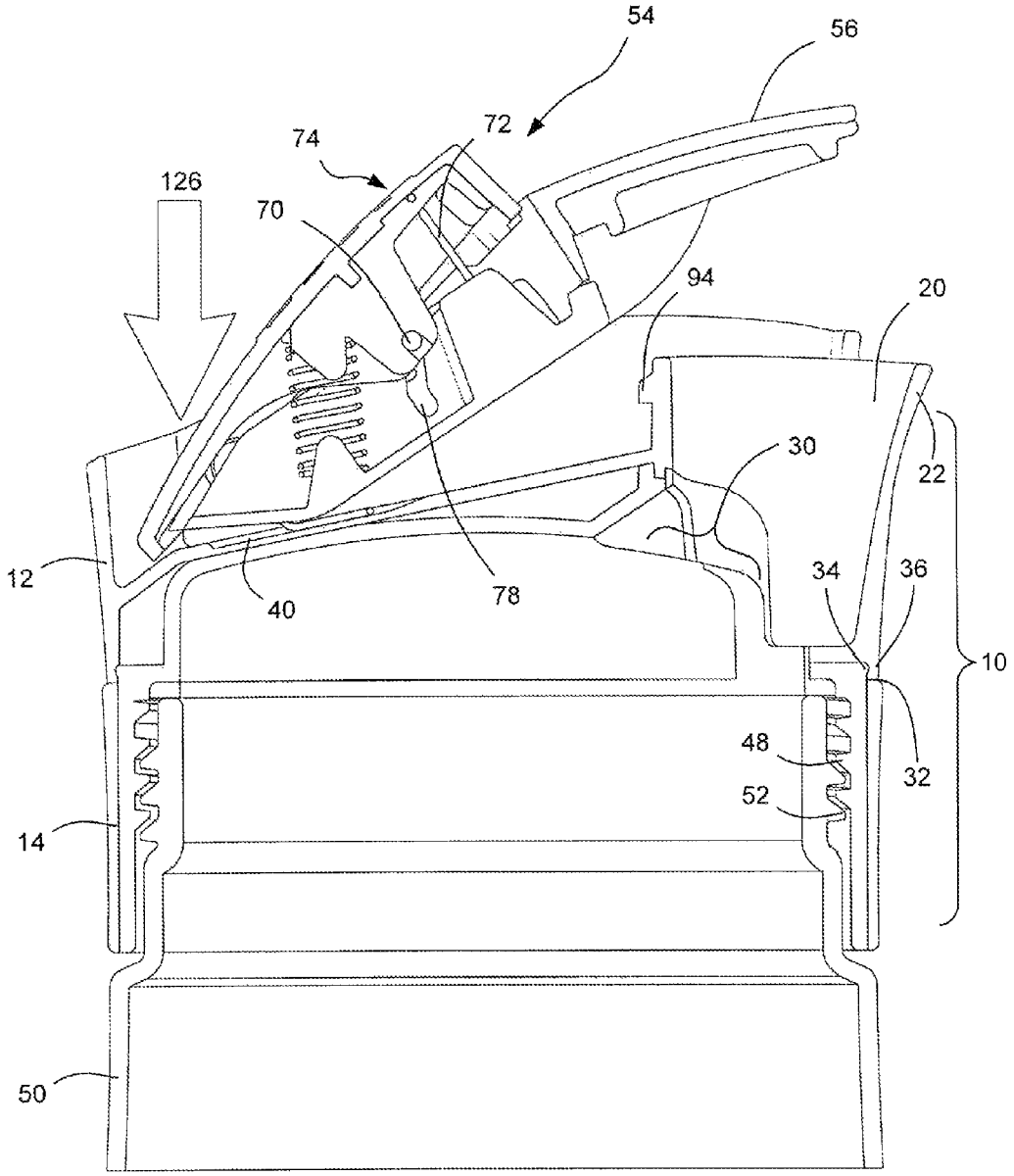
FIG. 4 illustrates a cross-sectional side view thereof wherein the push button latching assembly is being depressed for removal.
Figure 5:
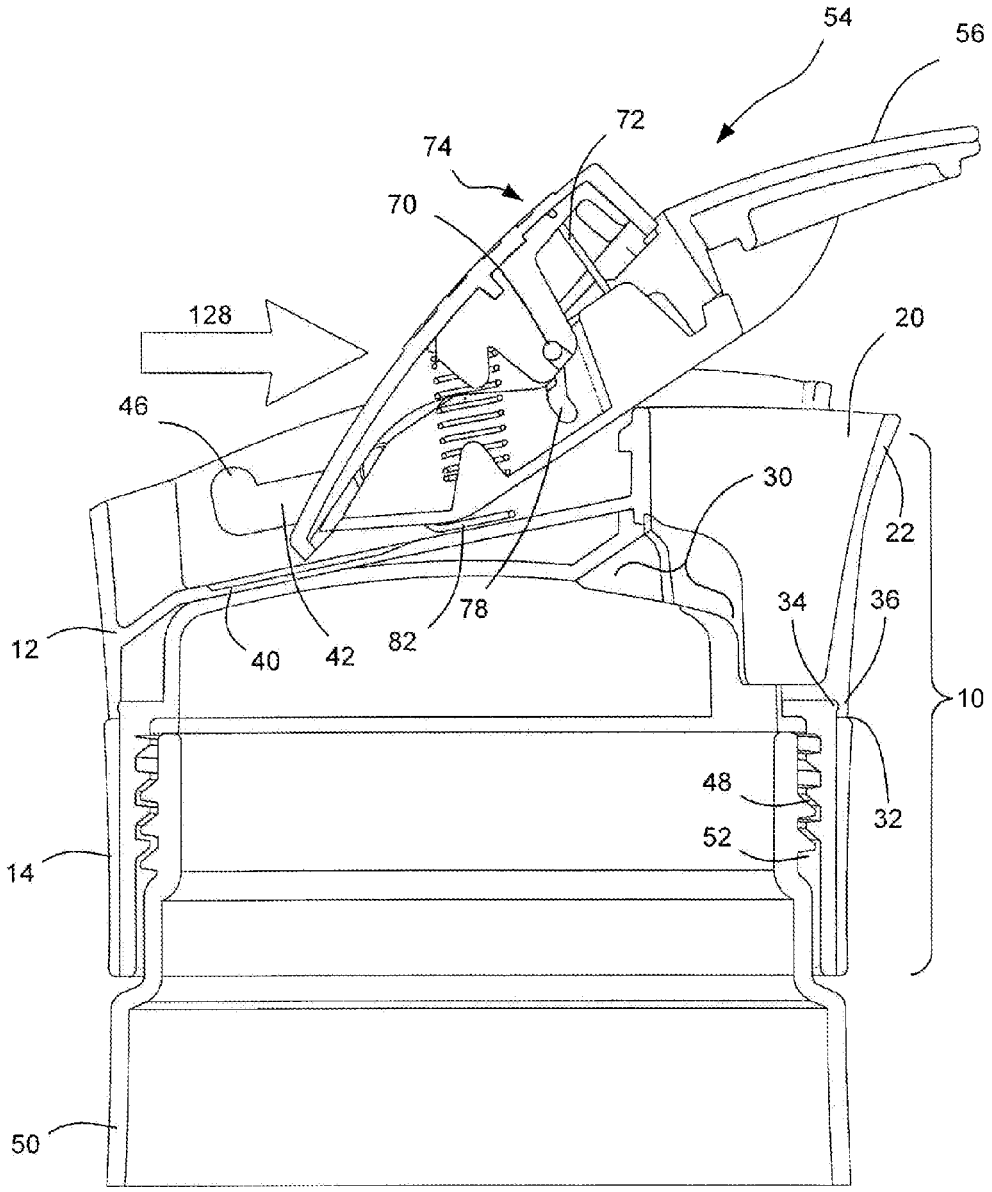
FIG. 5 illustrates a cross-sectional side view thereof wherein the push button latching assembly is being slid forward for removal.
Figure 6:
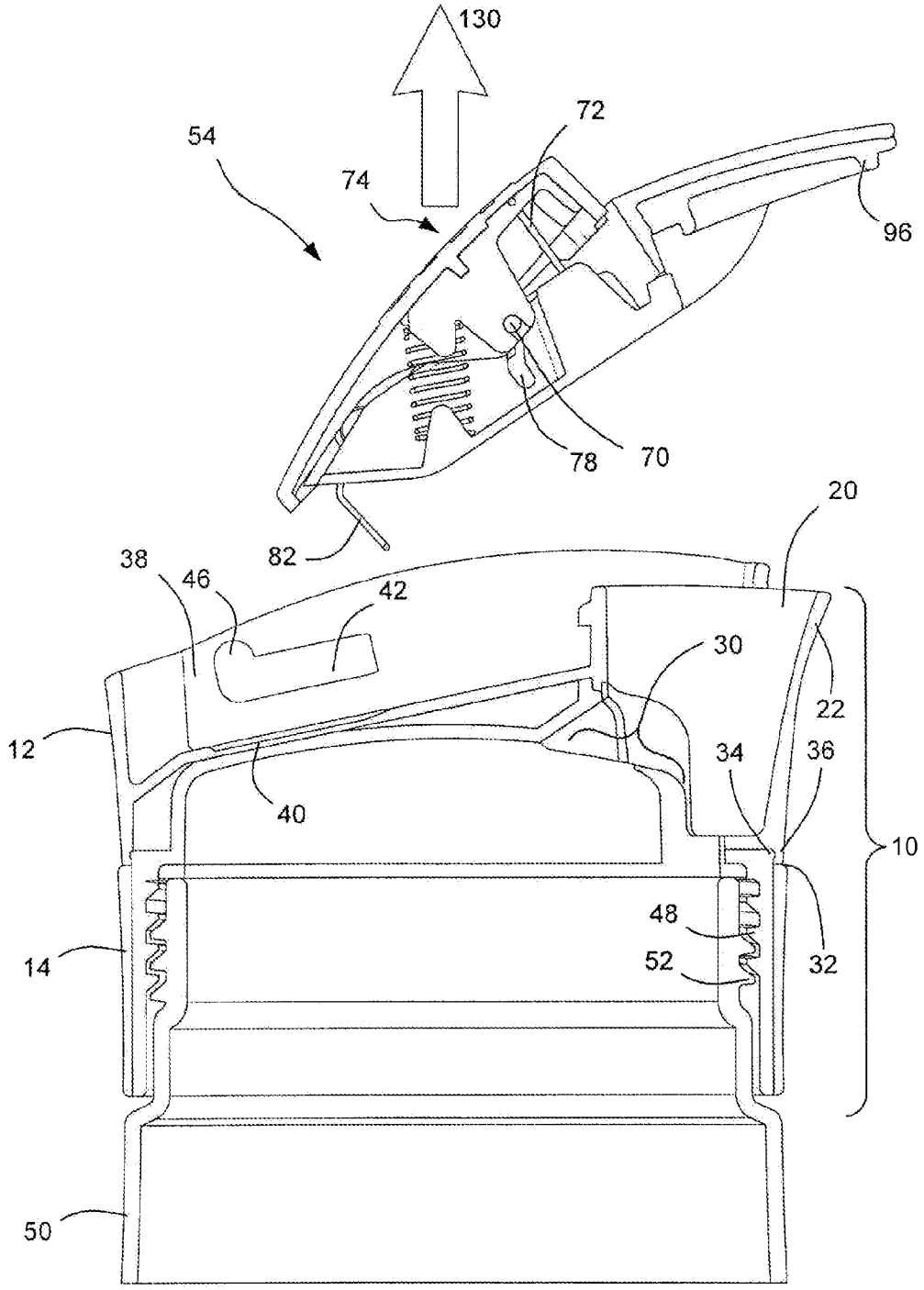
FIG. 6 illustrates a cross-sectional side view thereof wherein the push button latching assembly is being removed for cleaning.

In some embodiments, push button latching assembly 54 is configured such that pivot retaining pins 86 can be compressed and thus permit the assembly to be fully removed from closure 10 for cleaning. With reference to FIGS. 4 through 6, the forgoing removal process, according to some embodiments, is further described. As depicted in FIG. 4, when push button latching assembly 54 is in the open position, a user can apply a downward force 126 to the back portion of the assembly using his or her index finger while gripping the sides of the assembly 54 with his or her other hand. The motion described above moves pivot retaining pins 86 out of slot/notch 46 such that it is axially aligned with slot 42. In some embodiments, slot 42 is ramped at 44. According to such embodiments, as pivot retaining pins 86 become axially aligned with slot 42, the assembly 54 is capable of being pulled forward by user supplied force, as depicted in FIG. 5 at 128, such that ramps 44 depress pivot retaining pins 86 into the assembly sufficiently far that the assembly can be fully removed from cavity 38 defined by end wall 106 of closure 10 as depicted in FIG. 6 at 130.

In embodiments comprising chamfered pivot retaining pins 86, as illustrated in FIG. 7, the assembly 54 can be replaced to cavity 38 by pressing the chamfered surfaces 132 against the end wall 106 of closure 10 such that pivot retaining pins 86 are driven by the application of force into the assembly sufficiently far that it can be replaced to cavity 38. According to such embodiments, once the pivot retaining pins 86 are inside cavity 38, the assembly 54 is capable of being slid toward the back of closure 10, in a direction opposite spout 22, such that pivot retaining pins 86 resume pivotal insertion within notches 46. As the assembly 54 is replaced to cavity 38, the torsion spring 82 pushes against depression 40 and thereby applies a biasing force to retain pivot retaining pins 86 within notches 46 for subsequent pivotal use of push button latching assembly 54 as discussed and described above. In such embodiments, pivot retaining pins 86 and notches 46 define an operational pivotal axis about which the assembly 54 rotates as the assembly is moved between the open and closed positions discussed herein.

Thus, as discussed herein, various embodiments of the present invention embrace closures incorporating an integrated latching assembly, and more particularly closures with an integrated push button latching assembly for liquid containers such as bottles.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A closure having an integrated push button latching assembly for use with a liquid container, comprising:
- a first closure component having a first end wall;
- a first skirt wall depending from the first end wall;
- a first outlet opening associated with the first end wall;
- a protrusion associated with the first end wall; and
- the integrated push button latching assembly pivotally coupled to the first closure component, the push button latching assembly being movable between a first position in which the first outlet opening is covered by the push button latching assembly and a second position in which the first outlet opening is exposed, the push button latching assembly comprising:
  - a retaining mechanism;
  - a closing member coupled to the retaining mechanism;
  - a push button coupled to the retaining mechanism; and
  - a tongue coupled to the retaining mechanism,
- wherein the tongue is configured to matingly engage the protrusion when the push button latching assembly occupies the first position and disengage the protrusion such that the push button latching assembly is movable to the second position, the push button is configured to cyclically toggle the tongue between engagement and disengagement with the protrusion and the closing member is configured to close the first outlet opening when the push button latching assembly occupies the first position.

2. The closure recited in claim 1, further comprising a second closure component having a second end wall, a second skirt wall depending from the second end wall and a second outlet opening associated with the second end wall, wherein an internal surface of the second closure component comprises a continuous curvilinear surface.

3. The closure recited in claim 2, wherein the first closure component and the second closure component are interlockable along a common axis such that the first and second skirt walls are axially aligned and the first and second outlet openings are aligned.

4. The closure recited in claim 1, further comprising a cavity associated with the first end wall wherein the cavity is configured to pivotally receive the push button latching assembly.

5. The closure recited in claim 4, wherein the cavity further comprises one or more slots.

6. The closure recited in claim 5, wherein the push button latching assembly further comprises one or more pins configured to pivotally engage the one or more slots.

7. The closure recited in claim 6, wherein the one or more pins are biased to engage the one or more slots but are selectively disengageable from the one or more slots.

8. The closure recited in claim 7, wherein at least one of the one or more slots are ramped.

9. The closure recited in claim 8, wherein the push button latching assembly is selectively removable from the cavity.

10. The closure recited in claim 1, wherein the push button latching assembly further comprises a torsion spring coupled to the retaining mechanism and configured to bias the push button latching assembly in the second position.

11. The closure recited in claim 1, wherein the push button latching assembly further comprises a spring disposed adjacent the push button so as to bias the push button against depression and to facilitate the cyclical toggling of the tongue between engagement and disengagement with the protrusion.

12. The closure recited in claim 1, wherein the push button latching assembly further comprises a reversing mechanism and the tongue further comprises tracks which the reversing mechanism traverses to facilitate the cyclical toggling of the tongue between engagement and disengagement with the protrusion.

13. The closure recited in claim 12, wherein the tracks are sloped such that the tongue is slidable between a first tongue position and a second tongue position to facilitate the cyclical toggling of the tongue between engagement and disengagement with the protrusion.

14. A closure having an integrated push button latching assembly for use with a liquid container, comprising:
- an end wall;
- a skirt wall depending from the end wall;
- an outlet opening associated with the end wall;
- a protrusion associated with the end wall; and the integrated push button latching assembly pivotally coupled to the closure, the push button latching assembly being movable between a first position in which the outlet opening is covered by the push button latching assembly and a second position in which the outlet opening is exposed, the push button latching assembly comprising:

a retaining mechanism;

a closing member coupled to the retaining mechanism;

a push button coupled to the retaining mechanism; and a tongue coupled to the retaining mechanism, wherein the tongue is configured to matingly engage the protrusion when the push button latching assembly occupies the first position and disengage the protrusion such that the push button latching assembly is movable to the second position, the push button is configured to cyclically toggle the tongue between engagement and disengagement with the protrusion and the closing member is configured to close the outlet opening when the push button latching assembly occupies the first position.

15. The closure of claim 14, further comprising a spring coupled to the tongue and the push button.

16. A closure and liquid container system configured for single handed use, comprising:

a liquid container; and a closure configured to form a liquid sealing engagement with the liquid container, comprising an end wall;

a skirt wall depending from the end wall;

an outlet opening associated with the end wall;

a protrusion associated with the end wall; and a push button latching assembly pivotally coupled to the closure, the push button latching assembly being movable between a first position in which the outlet opening is covered by the push button latching assembly and a second position in which the outlet opening is exposed, the push button latching assembly comprising:

a retaining mechanism;

a closing member coupled to the retaining mechanism;

a push button coupled to the retaining mechanism; and a tongue coupled to the retaining mechanism, wherein the tongue is configured to matingly engage the protrusion when the push button latching assembly occupies the first position and disengage the protrusion such that the push button latching assembly is movable to the second position, the push button is configured to cyclically toggle the tongue between engagement and disengagement with the protrusion and the closing member is configured to close the outlet opening when the push button latching assembly occupies the first position.

17. The closure and liquid container system of claim 16, further comprising a pin connected to the push button latching assembly, the pin movable within a slot when the push button moves between the first and the second positions.

18. The closure and liquid container system of claim 16, further comprising a plurality of tracks disposed in the tongue, the tracks configured to facilitate movement of the tongue between engagement and disengagement with the protrusion.

19. The closure and liquid container system of claim 16, wherein the closure comprises a first closure component and a second closure component.

20. The closure and liquid container system of claim 16, further comprising a spring coupled to the tongue and the push button.

* * * * *